US007950103B2

(12) United States Patent
Williamson et al.

(10) Patent No.: US 7,950,103 B2
(45) Date of Patent: May 31, 2011

(54) PORTABLE CLEANING SYSTEM

(75) Inventors: Susan J. Williamson, Clarkston, MI (US); Glen E. Moore, St. Clair Shores, MI (US)

(73) Assignee: Nilfisk-A/S, Brondby (DK)

( * ) Notice: Subject to any disclaimer, the term of this patent is extended or adjusted under 35 U.S.C. 154(b) by 0 days.

(21) Appl. No.: 12/482,779

(22) Filed: Jun. 11, 2009

(65) Prior Publication Data

US 2009/0307865 A1 Dec. 17, 2009

Related U.S. Application Data

(60) Provisional application No. 61/060,914, filed on Jun. 12, 2008, provisional application No. 61/060,919, filed on Jun. 12, 2008.

(51) Int. Cl.
*A47L 5/24* (2006.01)

(52) U.S. Cl. ..... 15/329; 15/327.5; 15/344

(58) Field of Classification Search ..... 15/329, 15/347, 344, 328, 327.5, 410, 412, 340.2, 15/377

See application file for complete search history.

(56) References Cited

U.S. PATENT DOCUMENTS

| | | | | |
|---|---|---|---|---|
| 2,636,207 | A | 4/1953 | Reece | |
| 4,888,849 | A | 12/1989 | Hult et al. | |
| 5,267,371 | A | 12/1993 | Soler et al. | |
| 5,309,600 | A * | 5/1994 | Weaver et al. | 15/328 |
| 5,445,398 | A | 8/1995 | Pierce | |
| 5,504,412 | A | 4/1996 | Chan et al. | |
| 5,722,110 | A * | 3/1998 | McIntyre et al. | 15/329 |
| 6,066,211 | A | 5/2000 | Sandell | |
| 6,094,775 | A * | 8/2000 | Behmer | 15/329 |
| 6,295,692 | B1 | 10/2001 | Shideler | |
| 6,553,610 | B1 | 4/2003 | Shideler | |
| 6,976,287 | B2 * | 12/2005 | Muth | 15/340.1 |
| 7,185,389 | B2 | 3/2007 | Thomason et al. | |
| 7,188,388 | B2 * | 3/2007 | Best et al. | 15/329 |
| 2005/0011037 | A1 | 1/2005 | Zhao et al. | |
| 2005/0086762 | A1 | 4/2005 | Paris | |
| 2007/0289085 | A1 * | 12/2007 | Yoo | 15/334 |

* cited by examiner

*Primary Examiner* — Dung Van Nguyen

(74) *Attorney, Agent, or Firm* — Oppenheimer Wolff & Donnelly LLP

(57) ABSTRACT

A portable vacuum cleaning system includes a portable vacuum unit for cleaning debris. The vacuum unit is powered by a self-contained first battery and may be carried with a strap in backpack-fashion. The system also includes a cart defining a receptacle for receiving the vacuum unit. The vacuum unit may be used when supported by the cart or when carried by an operator. A second battery is supported by the cart and electrically connectable to the vacuum unit for charging the first battery when the vacuum unit is supported by the cart. Further, when disposed in the cart, the vacuum unit is disposed at an angle of about 45 degrees allowing for ease of movement of the cart.

15 Claims, 9 Drawing Sheets

PORTABLE CLEANING SYSTEM

CROSS REFERENCE TO RELATED APPLICATION

This application claims the benefit of provisional patent application No. 61/060,914, filed Jun. 12, 2008, and provisional patent application No. 61/060,919, filed Jun. 12, 2008, each of which is hereby incorporated by reference.

BACKGROUND OF THE INVENTION

1. Field of the Invention

The subject invention relates generally to portable vacuum cleaning systems.

2. Description of the Related Art

"Backpack" vacuum cleaners have become popular tools of those in the professional cleaning industry. These vacuum cleaners are typically carried by a person via a pair of straps similar to a traditional backpack. Some backpack vacuum cleaners are plugged into utility power while others include batteries to supply electricity to a motor/fan.

Unfortunately, "plug-in" backpack vacuum cleaners have the disadvantage of maneuvering with a cumbersome cord that typically must be unplugged and re-plugged as cleaning moves from room to room in a building. Battery-powered vacuum cleaners are saddled with two disadvantages. First, the batteries are often heavy, which can cause strain on the person utilizing the vacuum cleaner. Second, the charge held by the batteries is often limited, thus necessitating frequent charging and/or replacement of the batteries. Each of these problems limits the efficiency of the persons using the backpack vacuum cleaners to adequately clean an area.

The present invention addresses these and other disadvantages of prior art backpack vacuum cleaners.

SUMMARY OF THE INVENTION AND ADVANTAGES

In one aspect of the subject invention, a portable vacuum cleaning system includes a vacuum unit for cleaning debris from an area. The vacuum unit includes a motor and a first battery electrically connected to the motor for providing electrical power to run the motor. A fan is operatively connected to the motor for generating a vacuum to collect the debris. A filter element is in fluidic communication with the fan for capturing the debris. The system also includes a cart that is movable about the area. The cart includes a receptacle for receiving the vacuum unit such that the vacuum unit may be used when supported by the cart and allowing removal of the vacuum unit for independent operation of the vacuum unit apart from the cart. A second battery is supported by the cart and electrically connectable to the vacuum unit for charging the first battery when the vacuum unit is supported by the cart.

In another aspect of the subject invention, a portable vacuum cleaning system includes a vacuum unit for cleaning debris from an area. A cart includes at least one wheel and is movable about a surface of the area. The cart includes a support element supporting the vacuum unit. The support element is disposed at an angle between 10 and 80 degrees with respect to the surface.

The cart serves as a portable recharging unit which can be easily moved around the area to charge the battery of vacuum unit. The cart need not be plugged-in to a power source to charge the first battery of the vacuum unit as the cart carries a separate, second battery holding an electric charge. This allows for convenient charging of the vacuum unit at any location in a facility that is being cleaned. Furthermore, the vacuum unit may be utilized while disposed in the cart. As such, a person operating the vacuum unit may alternately switch between operation of the vacuum unit in the cart or out of the cart.

Furthermore, the angled disposition of the support element of the cart allows for an angled disposition of the vacuum unit. This angled disposition provides easy movement and rotation of the cart, thus reducing strain on the person operating the vacuum unit.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate like or corresponding parts throughout the several views, a cleaning system 10 is shown herein.

Figure 1:
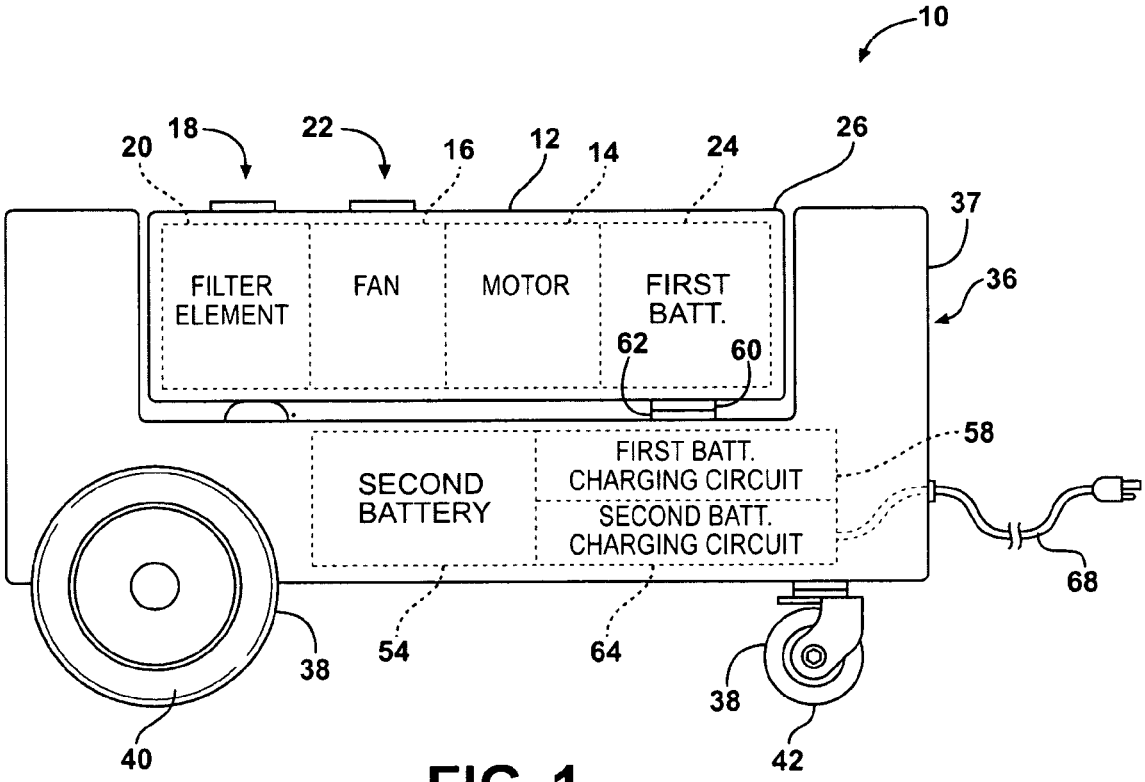
FIG. 1 is a block diagram of a cleaning system of the present invention showing a vacuum unit supported by a movable cart.

Referring to FIG. 1, the system 10 includes a vacuum unit 12 for cleaning debris from an area. In its simplest configuration, and as is well known to those skilled in the art, the vacuum unit 12 includes an electric motor 14 and a fan 16 operatively connected to one another. The fan 16 is in fluidic communication with an inlet 18. The motor 14 turns the fan 16 to generate a vacuum, i.e., suction, through the inlet 18 such that debris flows into the inlet 18. A filter element 20 and an outlet 22 are also in fluidic communication with the fan 16 such that the filter element 20 captures the debris and air flows out the outlet 22. The filter element 20 may be implemented in any of various techniques know to those skilled in the art, including, but not limited to, a filter bag and/or a filter disposed in a canister or cup.

Figure 2:
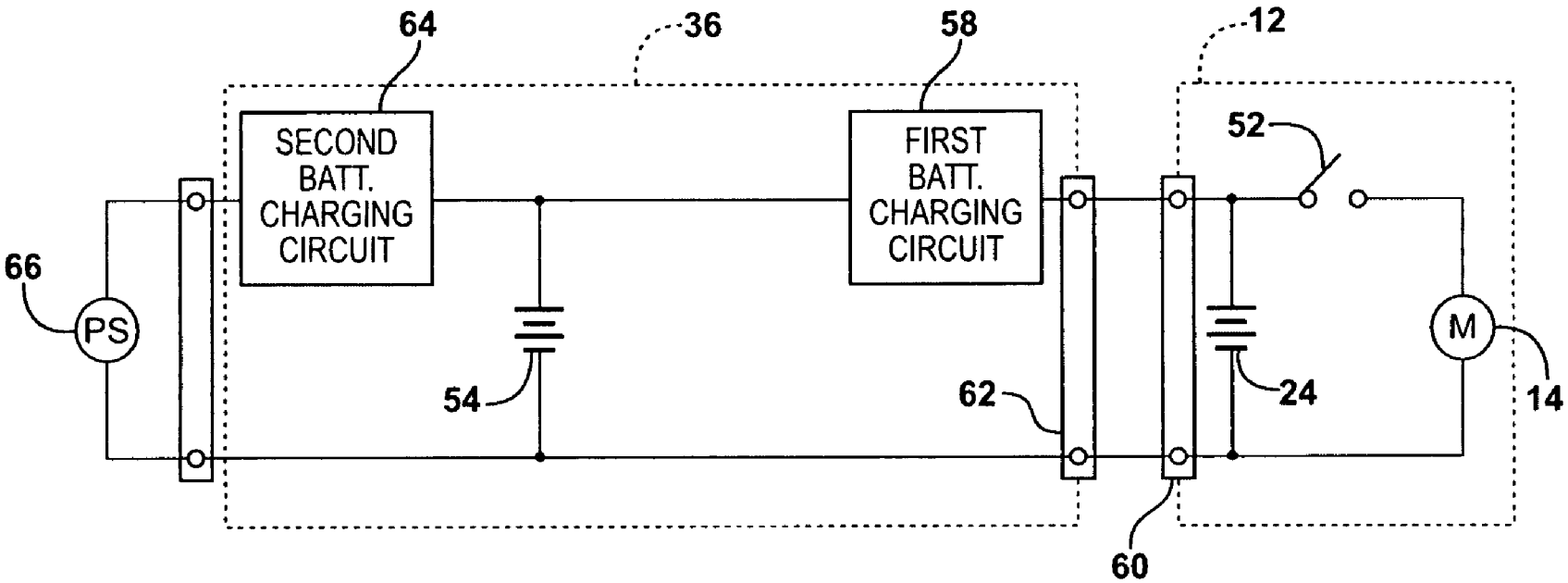
FIG. 2 is an electrical schematic diagram of the cleaning system.

In the present invention, as shown in FIGS. 1 and 2, a first battery 24 is electrically connectable to the motor 14. The first battery 24 provides electrical power to run the motor 14 and allows the vacuum unit 12 to move and operate about an area without maintaining a connection to standard AC, i.e., plug-in, utility power. The first battery 24 may be made up of one cell or multiple cells (not separately numbered) for holding an electrical charge. The cell(s) of the first battery 24 are rechargeable and may be of the various types known to those skilled in the art. Furthermore, multiple cells of the first battery 24 may be electrically connected in series and/or parallel to produce the necessary electrical power characteristics to the motor 14.

Figure 3:
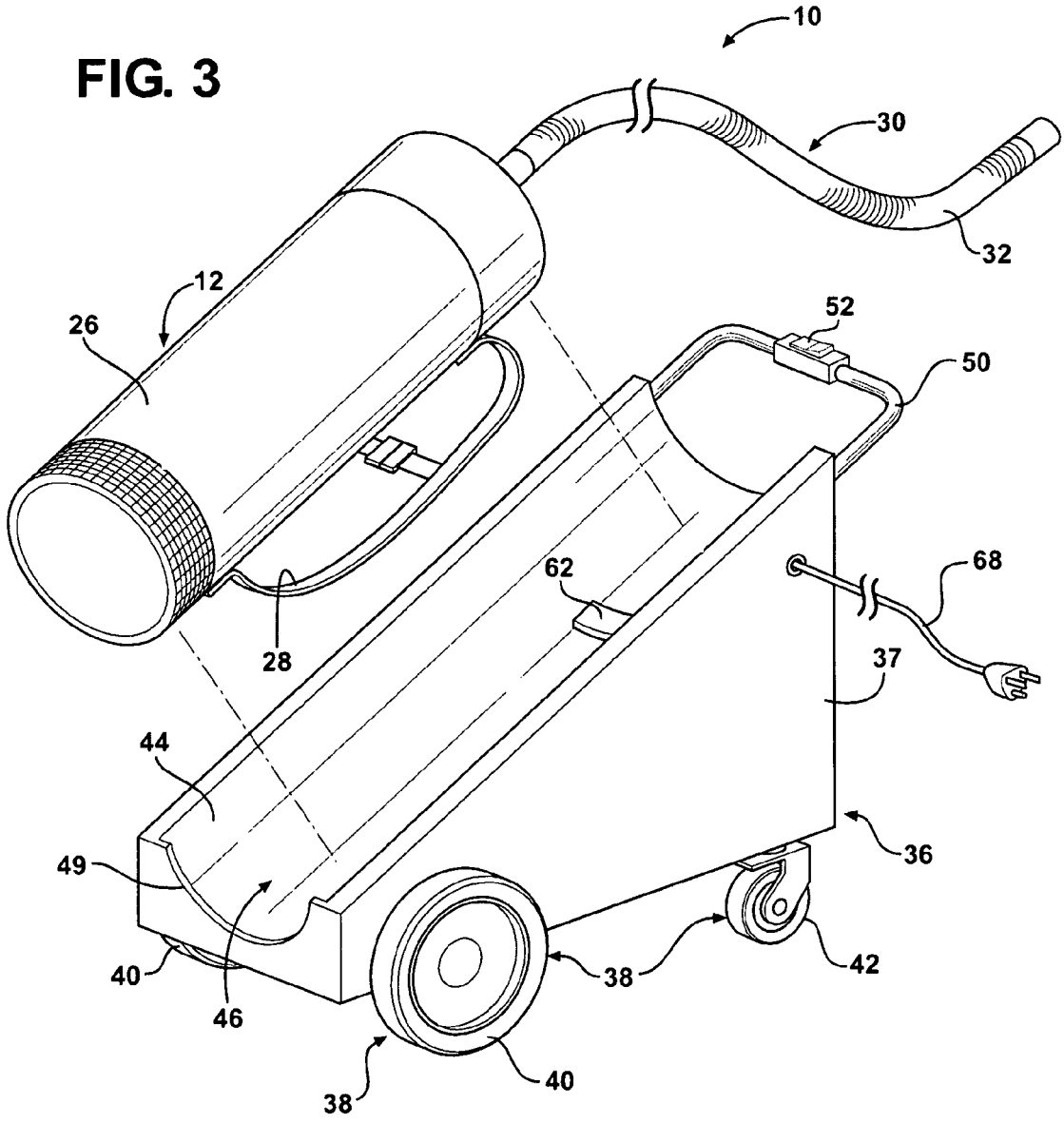
FIG. 3 is a perspective view of one embodiment of the system showing the vacuum unit removed from a receptacle of the movable cart.
Figure 4:
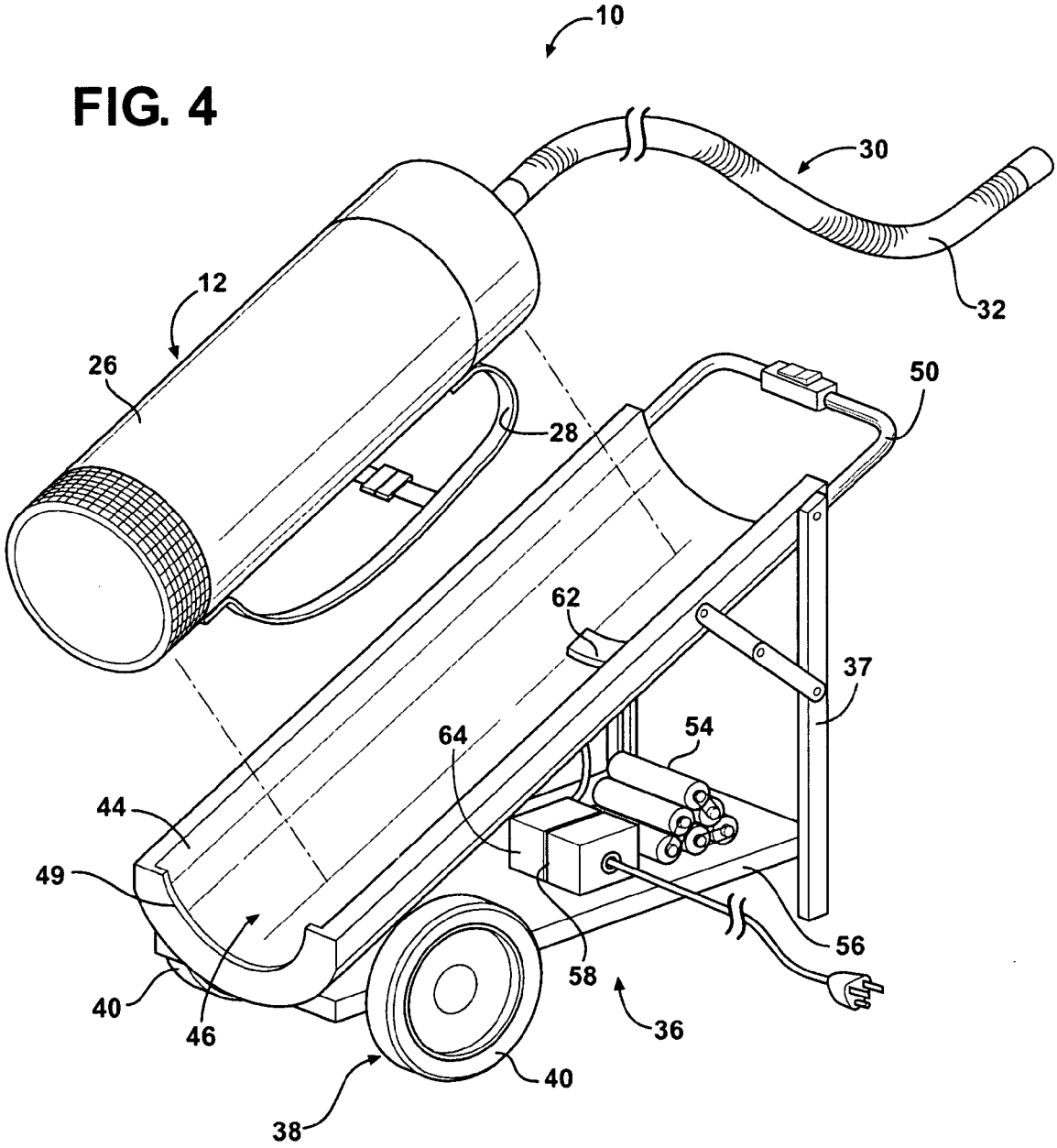
FIG. 4 is a perspective view of one embodiment of the system showing the movable cart being collapsible.

Referring to FIGS. 3 and 4, the vacuum unit 12 preferably includes a housing 26 for enclosing and linking together the first battery 24, the motor 14, and the filter element 20 such that the vacuum unit 12 may be transported as a single unit. As such, the vacuum unit 12 is portable about the area to be cleaned. Preferably, the housing 26 is cylindrically shaped and has a longitudinal axis (not labeled). However, other shapes for the housing 26 will be realized by those skilled in the art. Alternatively, instead of the housing 26, a connecting member (not shown) may be implemented to link together the first battery 24, the motor 14, and filter element 20 without enclosure of these components. The connecting member may be a rod (not shown) or stanchion (not shown) with various fasteners (not shown) as will be understood by those skilled in the art.

Figure 5:
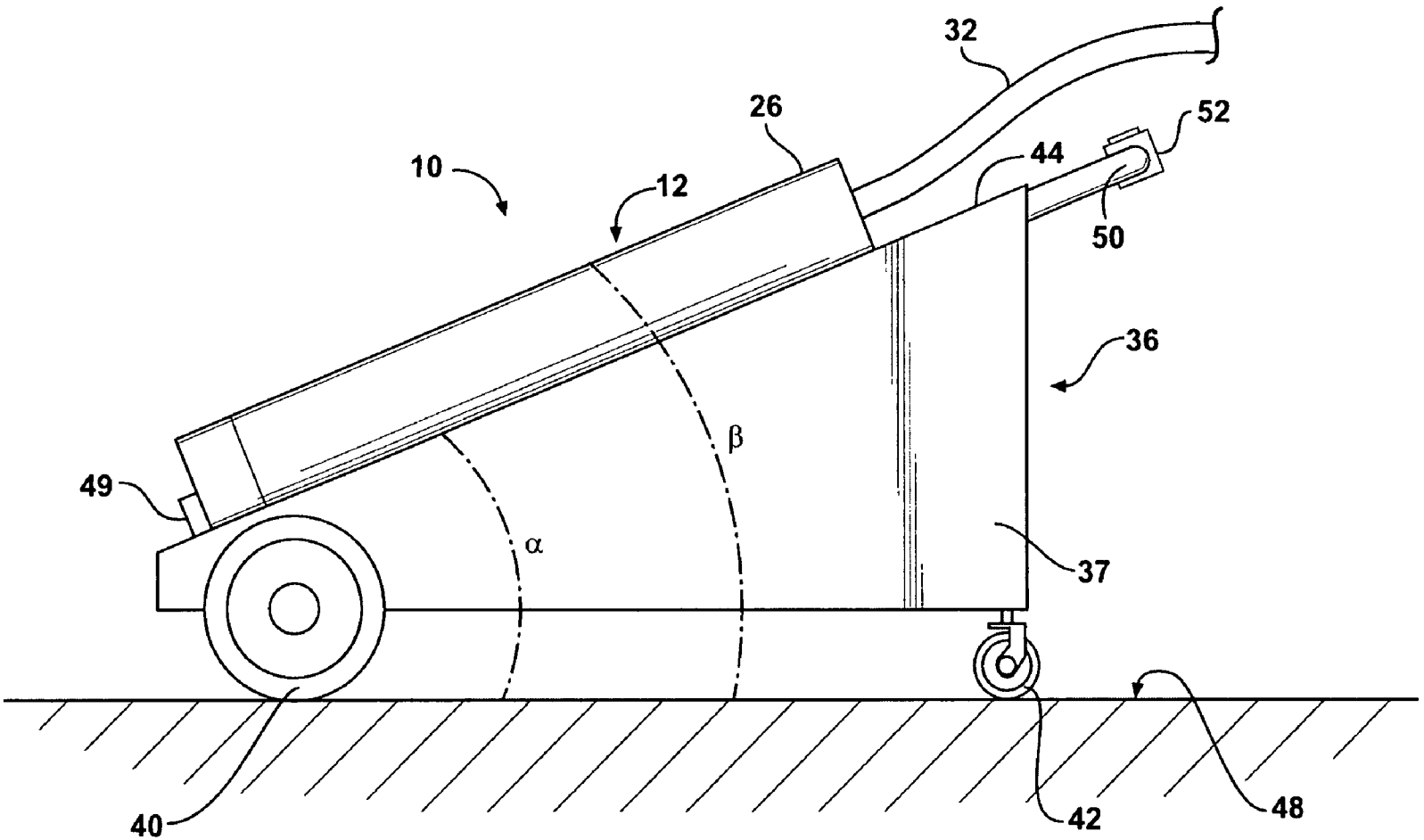
FIG. 5 is a side view of one embodiment of the system showing the angles of a support element of the cart and the vacuum unit with respect to a surface.

The vacuum unit 12 also preferably includes at least one strap 28 coupled to the housing 26 for support of the vacuum unit 12 by a person. As such, the vacuum unit 12 can be easily carried and operated about the area by the person. In one instance, as shown in FIG. 5, the at least one strap 28 is implemented as a pair of straps 28 such that the vacuum unit 12 can be worn in a backpack-fashion by the person. Those skilled in the art realize numerous techniques for implementing the at least one strap 28 to support the vacuum unit 12. Furthermore, a handle (not shown), apart from the strap(s) 28, may also be coupled to the vacuum unit for handling the vacuum unit 12.

The vacuum unit 12 may include one or more tubular elements 30 connected to the inlet 18 for ease in collecting the debris. In the embodiment shown in FIG. 5, the tubular elements 30 include a flexible hose 32 connected to the inlet 18 and a rigid wand 34 connected to the flexible hose 32. A nozzle 35, of the numerous types known to those skilled in the art, may be connected to an end of the flexible hose 32 for direct application to a surface of the area being cleaned. The nozzle 35 may include a rotating brush (not shown) for loosening debris on the surface. A second motor (not shown) may be operatively connected to the brush for providing rotation thereto. The second motor may be electrically connected to the first battery 24 to provide power to the second motor.

The system 10 also includes a portable cart 36 movable about the area that is to be cleaned. The cart 36 includes a frame 37 operatively connected to and supported by at least one wheel 38. In one embodiment, as shown in FIG. 4, the at least one wheel 38 is implemented as a pair of standard wheels 40. In another embodiment, as shown in FIG. 3, the at least one wheel 38 is implemented as a pair of standard wheels 40 and a pair of pivoting casters 42. The pivoting casters 42 allow easy turning and rotation of the cart 36. In yet another embodiment (not shown), the wheels 38 are all implemented as pivoting casters 42. Those skilled in the art realize numerous other configurations of wheels 38 to allow movement of the portable cart 36 about the area.

Referring to FIGS. 3 and 4, the frame 37 includes a support element 44 defining a receptacle 46. The receptacle 46 receives the vacuum unit 12 such that the support element 44 removably supports the vacuum unit 12. That is, the vacuum unit 12 is removable from the receptacle 46 for allowing operation of the vacuum unit 12 when supported by the support element 44 and also allowing independent operation of the vacuum unit 12 when removed from the support element 44. The receptacle 46 may also receive other components, an example of which is described in detail below. However, in alternative embodiments, the vacuum unit 12 is fixed to the support element 44 such that the vacuum unit 12 may not be easily removed from the cart 36. Said another way, the vacuum unit 12 and cart 36 may have a unified or "unibody" construction.

In some embodiments, as shown in FIGS. 3 and 4, the support element 44 defines a longitudinal axis (not labeled) and has a semicircular cross-section such that the receptacle 46 may accommodates the cylindrical shape of the housing 26 of the vacuum unit 12. Of course, the support element 44 may be of any various shapes and configurations.

Referring now to FIG. 4, the support element 44 is preferably disposed at an angle $\alpha$ between 10 and 80 degrees with respect to a surface 48, e.g., a floor, on which the cart 36 is supported. More specifically, the angle $\alpha$ is defined between the longitudinal axis of the support element 44 and the surface 48. More preferably, the support element 44 is disposed at an angle $\alpha$ between 35 and 55 degrees with respect to the surface 48. Most preferably, the support element 44 is disposed at an angle $\alpha$ of about 45 degrees with respect to the surface 48. As such, the vacuum unit 12 is also disposed at an angle $\beta$ between 10 and 80 degrees with respect to the surface when the vacuum unit 12 is supported by the cart 36. However, the angle $\alpha$ of the support element 44 and the angle $\beta$ of the vacuum unit 12 may not necessarily be equivalent to one another.

It is further preferred that the support element 44 is unhingibly disposed at the angle $\alpha$. Said another way, the angle $\alpha$ is not readily adjustable during movement of the cart 36 and operation of the vacuum unit 12. However, in other embodiments, the angle $\alpha$ may be adjusted only when the cart 36 is not being moved. In yet other alternative embodiments, the angle $\alpha$ may be adjusted at any time.

Disposing the support element 44 and the vacuum unit 12 at inclined angles $\alpha$, $\beta$ provides for ease of movement of the cart 36. When compared to prior art "canister vacuums", the system 10 of the present invention moves quite easily about the surface 48 without undue exertion of force by the operator.

The cart 36 also preferably includes at least one securing mechanism (not labeled) for securing the vacuum unit 12 to the cart 36. In the illustrated embodiments, the securing mechanism is implemented as a combination of the semicircular shape of the support element 44, which mates with the cylindrical shape of the vacuum unit 12, along with a stop piece 49 to prevent sliding of the vacuum unit 12 out of the support element 44. Alternatively, or additionally, the straps 28 may be used to secure the vacuum unit 12 to the cart 36. The securing mechanism may be implemented by other techniques in other embodiments (not shown), such as, but not limited to, fasteners and other mechanical couplers. Those skilled in the art contemplate other suitable techniques for securing the vacuum unit 12 to the cart 36.

The system 10 also preferably includes a handle 50 operatively connected to the cart 36 for assisting in maneuvering the cart 36 about the area. The handle 50 may be formed of metal, plastic, or any other suitable material. Furthermore, the handle 50 may be shaped as a closed loop, have a Y-shape, or other suitable shape. The handle 50 may be fixed to match the angle $\alpha$ of the support element 44 or the handle may be hinged to allow pivoting movement of the handle 50.

Figure 6:
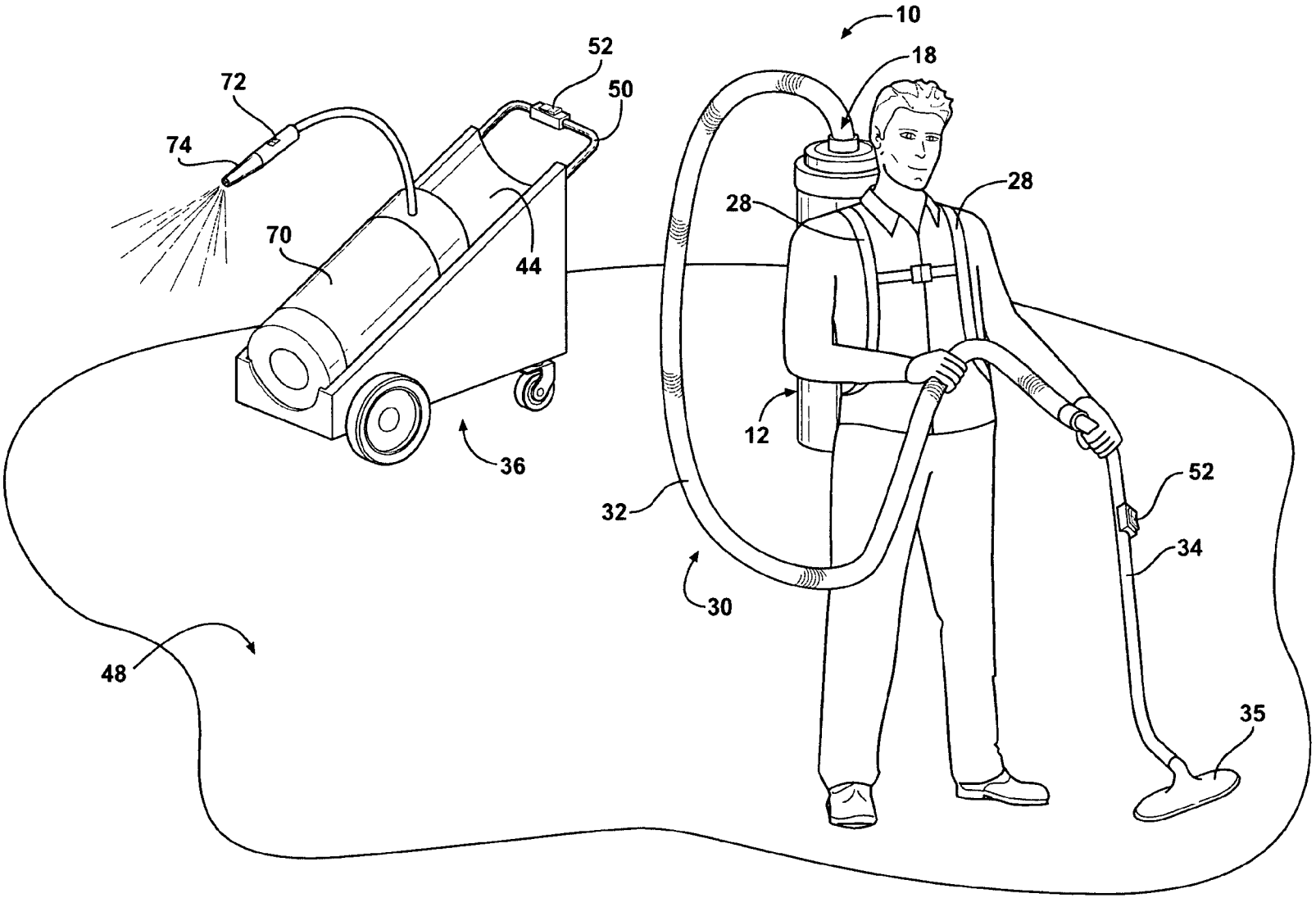
FIG. 6 is a perspective view of the system showing the vacuum unit wearable by a person and the movable cart supporting a canister for storing and dispensing a carpet/upholstery spotting solvent.

As shown in FIG. 2, the system 10 includes at least one switch 52 to control operation of the motor 14 and the fan 16 by the person operating the system 10. The switch 52 (or switches 52) is electrically connected between the first battery 24 and the motor 14. The switch 52 is preferably physically disposed at a location that is easily accessible by the person. For instance, as shown in FIG. 6, the switch 52 may be disposed on one of the tubular elements 32 at a handhold position (not labeled) of the rigid wand 34. The switch 52 may also be disposed on the handle 50 of the cart 36 for convenient operation. Preferably, the system 10 includes a pair of switches 52, one mounted on the tubular element 32 and one mounted on the handle 50, such that either switch 52 may turn on and off the motor 14 when the vacuum unit 12 is disposed in receptacle 46 of the cart 36.

Referring again to FIG. 2, the system 10 also includes a second battery 54 for charging the first battery 24 of the vacuum unit 12. The second battery 54 is electrically connectable to the first battery 24 when the vacuum unit 12 is disposed in the receptacle 46. The second battery 54 is preferably a rechargeable type battery as known to those skilled in the art. As such, the second battery 54 is preferably also rechargeable, as described in detail below.

The second battery 54 is preferably supported by the frame 36 of the cart 36. Specifically, as best shown in FIG. 4, the frame 36 includes a battery shelf 56 for supporting the second battery 54. In FIG. 4, the second battery 54 is shown as a plurality of cylindrical cells. However, the second battery 54 may be of any shape or type as readily appreciated by those skilled in the art.

The system 10 includes a first battery charging circuit 58 electrically connected to the second battery 54 and electrically connectable to the first battery 24 for charging the first battery 24 from the second battery. 54. The first battery charging circuit 58 includes necessary circuitry (e.g., diodes) to prevent reverse charging of the second battery 54 from the first battery 24. That is, electric current generally only flows from the second battery 54 to the first battery 24, and not vice-versa.

The system 10 also preferably includes a first electrical connector 60 and a second electrical connector 62 for electrically connecting the cart 36 to the vacuum unit 12. The first electrical connector 60 is electrically connected to the first battery 24. The first electrical connector 60 is preferably disposed on the housing 26 of the vacuum unit 12. The second electrical connector 62 is electrically connected to the first battery charging circuit 58. The second electrical connector 62 is preferably disposed on the support element 44 as shown in FIGS. 3 and 4. The electrical connectors 60, 62 are engagable with one another for allowing electrical power to flow therebetween. The electrical connectors 60, 62 may also serve to provide electrical connection between the switch 50 mounted on the handle 52 of the cart and the motor 14 of the vacuum unit 12.

The cart 36, as described above, serves as a portable recharging unit which can be easily moved around the area to charge the first battery 24 of the vacuum unit 12. The cart 36 need not be plugged-in to a power source to charge the first battery 24 of the vacuum unit 12 as the cart 36 carries a separate, second battery 54 holding an electric charge. This allows for convenient charging of the vacuum unit 12 at any location in a facility that is being cleaned. Furthermore, the vacuum unit 12 may be operated while disposed in the cart 36. As such, a person operating the vacuum unit 12 may alternately switch between operation of the vacuum unit 12 disposed in the cart 36 or out of the cart 36.

For example, the person carrying the vacuum unit 12 as a backpack may become fatigued due to the weight of the unit. The person can then remove the vacuum unit 12 and place it in the receptacle 46 of the cart 36 and still operate the vacuum unit 12. Furthermore, when the first battery 24 becomes discharged and can no longer power the motor 14, the vacuum unit 12 may be placed in the receptacle 46 for recharging by the second battery 54. Thus, the cart 36 permits continued operation and cleaning of the area under a variety of adverse circumstances.

The system 10 also includes a second battery charging circuit 64. The second battery charging circuit 64 is electrically connected between the second battery 54 and a power source 66. For charging the second battery 54 from the power source 66. The second battery charging circuit 64 is preferably supported by the cart 36. However, the second battery charging circuit 64 may alternatively be disposed at other locations. The power source 66 may be standard AC utility power that is readily available from, for instance, a wall socket, as is well known to those skilled in the art, and is electrically connected to the second battery charging circuit 64 via a cord 68. However, other power sources 66, e.g., solar cells, may alternatively be utilized.

In an alternative embodiment, the system 10 may also be implemented without batteries 24, 54 or charging circuits 58, 64. Specifically, the vacuum unit 12 is angularly supported by the cart 36 as described above. A power source, such as AC utility power, is electrically connected to the motor 14 for powering the vacuum unit 12. This embodiment allows for easy movement of the cart 36 and vacuum unit 12 about the area while reducing overall weight of the system 10.

Figure 7:
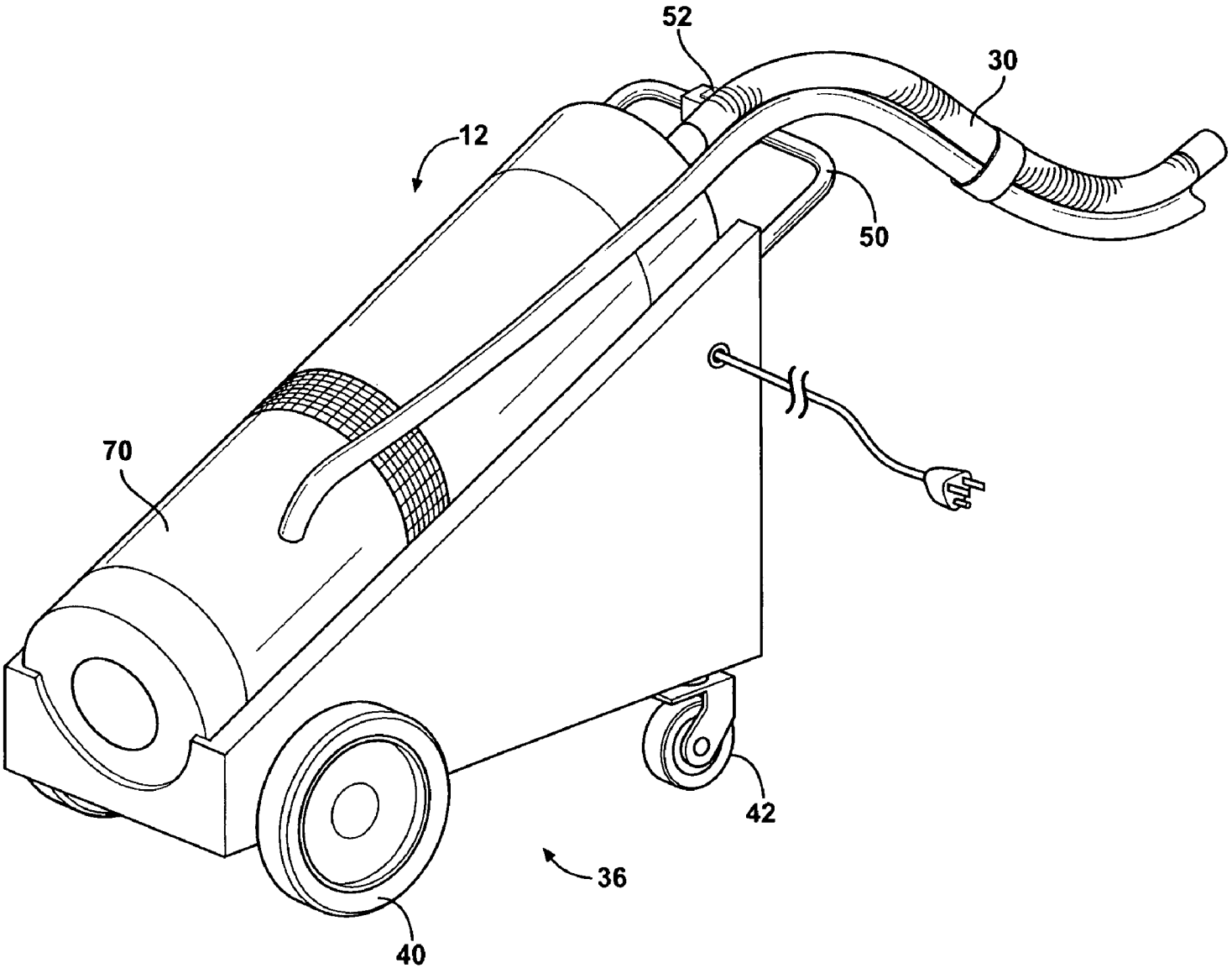
FIG. 7 is a perspective view of one embodiment of the system showing both the vacuum unit and the canister disposed in the receptacle of the movable cart.

The system 10 may also includes a canister 70 that is supportable by the support element 44, as shown in FIG. 6. In one embodiment, the canister 70 may contain a liquid solvent for application to carpeting and/or upholstery in the area. A tube (not numbered) is in fluidic communication with the canister 70. A dispensing button 72 regulates dispensing of the liquid solvent via a spout 74. In the embodiment illustrated in FIG. 6, the canister 50 is supported by the support element 44 when the vacuum unit 12 is removed from the cart 36. In other embodiments, such as that shown in FIGS. 7 and 9, the canister 70 and the vacuum unit 12 may be supported simultaneously by the cart 36. In these embodiments, the tube runs adjacent to the flexible hose 32 of the vacuum unit 12. As such, the liquid solvent may be applied adjacent to the nozzle 35 of the vacuum unit 12.

Figure 8:
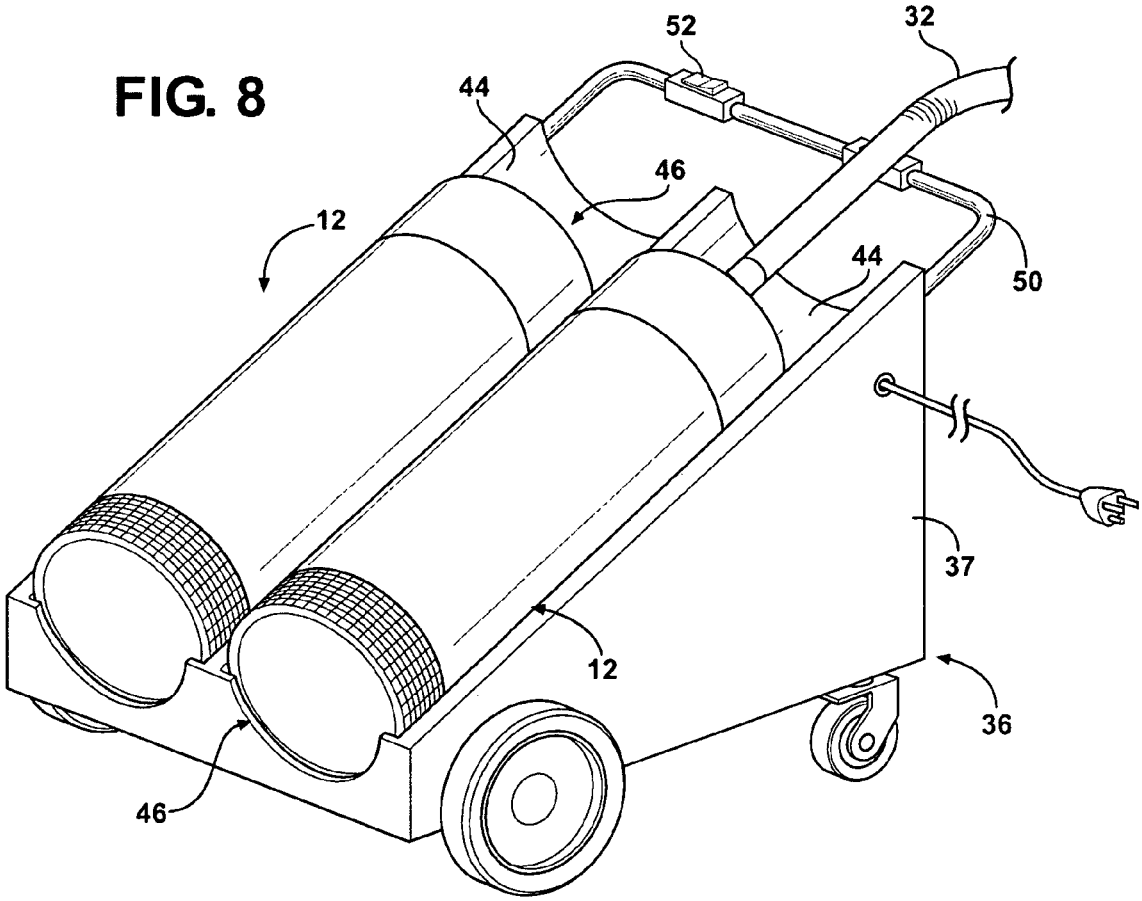
FIG. 8 is a perspective view of one embodiment of the system showing multiple receptacles defined by the cart with the receptacles supporting multiple vacuum units.
Figure 9:
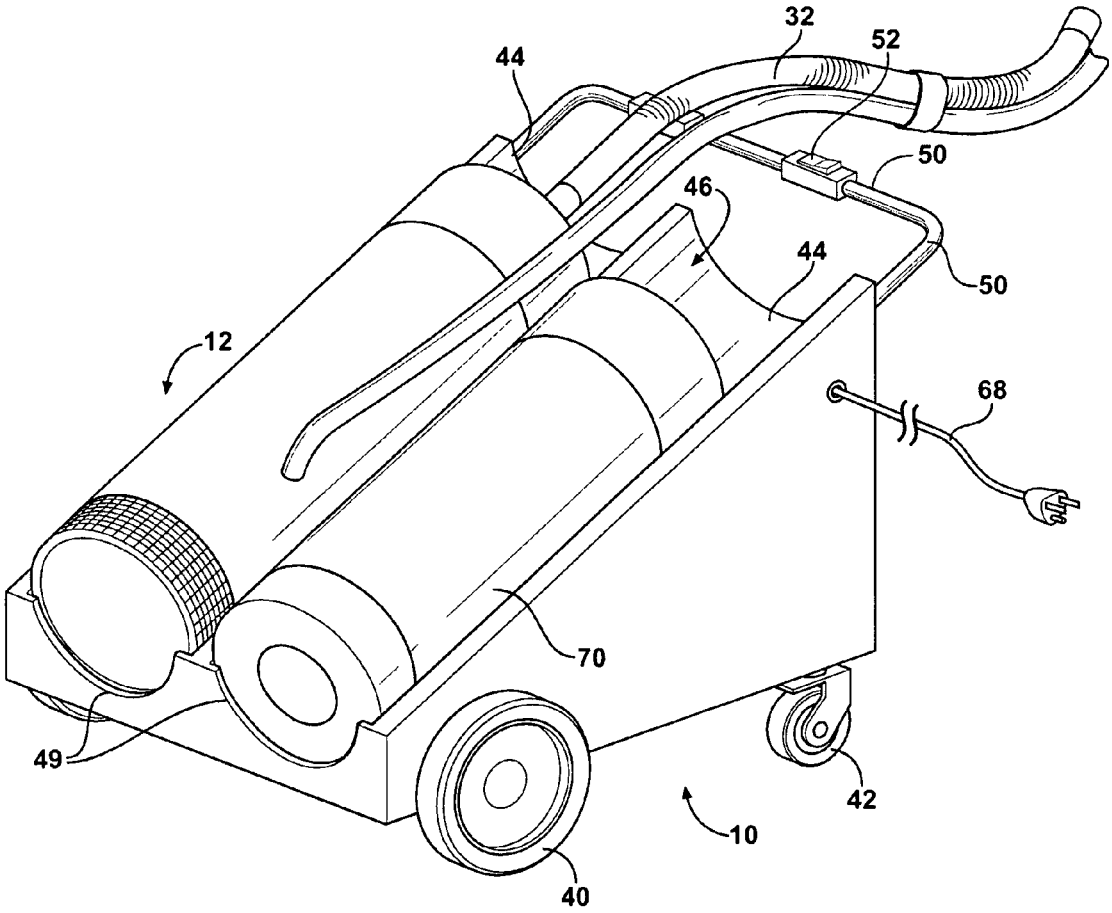
FIG. 9 is a perspective view of one embodiment of the system showing multiple receptacles defined by the cart with one receptacle supporting the vacuum unit and the other receptacle supporting the canister.

Referring now to FIGS. 8 and 9, the frame 37 of the cart 36 may include multiple support elements 44 to define multiple receptacles 46. As shown in FIG. 8, the multiple support elements 44 may be utilized to charge multiple vacuum units 12 simultaneously. As shown in FIG. 9, one of the support elements 44 may be utilized to support the vacuum unit 12 while another support element 44 may be utilized to support the canister 70.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A portable vacuum cleaning system comprising:

a vacuum unit for cleaning debris from an area including a motor, a first battery electrically connected to said motor for providing electrical power to run said motor, a fan operatively connected to said motor for generating a vacuum to collect the debris, and a filter element in fluidic communication with said fan for capturing the debris;

a cart movable about the area including a receptacle for receiving said vacuum unit such that said vacuum unit may be used when supported by said cart and allowing removal of said vacuum unit for independent operation of said vacuum unit apart from said cart; and a second battery supported by said cart and electrically connectable to said vacuum unit for charging said first battery when said vacuum unit is supported by said cart.

2. A system as set forth in claim 1 wherein said cart includes a first battery charging circuit electrically connected to said second battery and electrically connectable to said first battery for charging said first battery from said second battery.

3. A system as set forth in claim 2 wherein said cart includes a second battery charging circuit electrically connected to said second battery and electrically connectable to a power source for charging said second battery from the power source.

4. A system as set forth in claim 3 wherein said first battery charging circuit and said second battery charging circuit work in conjunction to charge both the first battery and the second battery when said vacuum unit is supported by said cart and said second battery charging circuit is connected to the power source.

5. A system as set forth in claim 2 wherein said vacuum unit includes a first electrical connector electrically connected to said first battery and said cart includes a second electrical connector electrically connected to said first battery charging circuit wherein said electrical connectors are engagable with one another for allowing electrical power to flow therebetween.

6. A system as set forth in claim 1 wherein said vacuum unit further includes a housing linking together said first battery, said motor, and said filter element such that said vacuum unit may be transported as a single unit.

7. A system as set forth in claim 6 wherein said vacuum unit includes at least one strap connected thereto for support of said vacuum unit by a person.

8. A system as set forth in claim 1 wherein said receptacle of said cart is defined by a support element for engaging with said vacuum unit.

9. A system as set forth in claim 8 wherein said support element is disposed at an angle between 10 and 80 degrees with respect to a surface supporting the cart.

10. A system as set forth in claim 9 wherein said vacuum unit is also disposed at an angle between 10 and 80 degrees with respect to the surface when said vacuum unit is supported by said cart.

11. A system as set forth in claim 9 further comprising a canister supportable by said support element.

12. A system as set forth in claim 11 wherein said canister contains a liquid solvent for application to carpeting and/or upholstery in the area.

13. A system as set forth in claim 1 wherein said cart includes a plurality of wheels for allowing movement about the area.

14. A system as set forth in claim 13 wherein at least one of said wheels is further defined as a caster.

15. A cleaning system cart comprising:

a frame;

a plurality of wheels operatively connected to said frame for allowing movement about an area;

said frame including a support element defining a receptacle for receiving a vacuum unit for cleaning debris from the area wherein the vacuum unit includes a first battery; and a second battery supported by said frame and electrically connectable to the vacuum unit for charging the first battery of the vacuum unit when the vacuum unit is disposed in said receptacle.

* * * * *